US005540020A

United States Patent [19]

Santini

[11] Patent Number: 5,540,020

[45] Date of Patent: Jul. 30, 1996

[54] BUILDING PANEL

[76] Inventor: Daniel E. Santini, 260 Cannon St., East Hamilton, Ontario, Canada, L8L 2B3

[21] Appl. No.: 311,439

[22] Filed: Sep. 26, 1994

[51] Int. Cl.[6] ..... E04B 1/04

[52] U.S. Cl. ..... 52/259; 52/309.7; 52/309.12; 52/309.16; 52/583.1

[58] Field of Search ..... 52/309.4, 309.7, 52/309.8, 309.12, 309.13, 309.15, 309.16, 309.17, 583.1, 250, 251, 586.1, 259, 260, 258

[56] References Cited

U.S. PATENT DOCUMENTS 4,038,798 8/1977 Sachs ..... 52/309.7 X
4,532,745 8/1985 Kinard ..... 52/309.12 X
4,823,534 4/1989 Hebinck ..... 52/309.12 X
5,129,203 7/1992 Romero ..... 52/309.12 X
5,231,813 8/1993 Drawdy ..... 52/309.12

*Primary Examiner*—Kien T. Nguyen

[57] ABSTRACT

A prefabricated panel is disclosed which has high structural strength and simplifies the fabrication of buildings on site. The panels cooperate with structural grid type members to provide infill for the grid while, more importantly, significantly contributing to the overall structural stability of the building. The structural grid type members, in a preferred embodiment, are of a cement material and can be poured in place in cavities preformed in the panels. The panels can be prefabricated and, in a preferred embodiment, for interior and exterior finish materials are part of the panels.

18 Claims, 3 Drawing Sheets

BUILDING PANEL

FIELD OF THE INVENTION

The invention is directed to building systems, and in particular to building systems which allow for substantial prefabrication.

1. Background of the Invention

Traditional building methods in Europe and North America work quite well, however, they are not particularly suited to the fabrication of houses or other buildings in less developed countries. It has generally been considered necessary for effective low cost building in such countries to do as much prefabrication as possible and reduce the complexity required to assemble the structure in its final location. In many applications, it is considered necessary to allow manual labour, such as two labourers, to easily handle the various components at the final location.

2. Summary of the Invention

The present invention is based on a prefabricated panel which includes an arrangement for convenient structural attachment of the panel to a beam and column. The panel cooperates with the beam and column to significantly improve the structural stability of the resulting combination.

In a preferred embodiment, the panels are designed to be placed end to end, and in so doing, form a cavity which receives a vertical structural component at the junction of the two abutted panels. The panel size and shape can be adjusted, depending upon the particular project and the local requirements including the skill level of the local labour.

In a preferred embodiment of the invention, the panels, when abutted in an end to end manner or when stacked one upon the other, define at the abutment a cavity which can receive and enclose a structural member. The structural member can then be attached to a structural core of the prefabricated panels.

In yet a further aspect of the invention, the structural members defined between abutting panels are cement type members or reinforced cement type members, which form an integral connection with the structural core of the prefabricated panels. These cement type structural members can be poured in place once the panels have been initially secured.

In yet a further embodiment of the invention, the columns and beams which form the structural members can be of a steel material and the structural core extends at the edges of the panels for securement to these structural members at a host of locations to thereby tie the beams, columns and structural core together to form a high strength building system.

In a preferred embodiment of the invention, the structural core has a steel mesh or gridwork running therethrough which extends either side of the panel. The steel mesh within the panel is encapsulated within a cement type material to produce a ferro cement type core with the steel mesh extending past the cement type member at the sides of the panel. This provides the panel with excellent structural characteristics, i.e. it has its own structural strength, and thus, is easily handled and this strength cooperates with the structural members when the panels are finally used to form a wall of a building to significantly contribute to the overall strength of the wall.

BRIEF DESCRIPTION OF THE DRAWINGS

Preferred embodiments of the invention are shown in the drawings, wherein.

DETAILED DESCRIPTION OF THE PREFERRED EMBODIMENTS

A building is formed by interconnecting prefabricated building panels and joining of the building panels to structural members. In contrast to other prefabricated panels, these building panels not only provide infill, but substantially contribute to the structural stability of the structure. In the preferred structure, the panels cooperate to define a cavity for receiving a structural member at junctions between panels. For example, two panels in horizontal abutment (i.e. side by side) form a cavity therebetween into which a vertical structural member can be placed or located. The panels also accommodate horizontal structural members when the panels are stacked.

This can be better understood with respect to the drawings. The prefabricated building panels 2 have a structural core 10 which is made up of a reinforcing mesh 12, preferably of steel, which mesh is embedded within a cementitious layer, generally shown as 14. This combination is generally referred to as ferrocement. The reinforcing mesh 12 extends either side of each panel and extends at the top edge of each panel. Metal mesh is preferred at this time, however, other meshes or fabrics can be used if the desired strength is achieved. For example, in some applications, fibreglass mesh or high strength plastic mesh may be sufficient.

Figure 1:
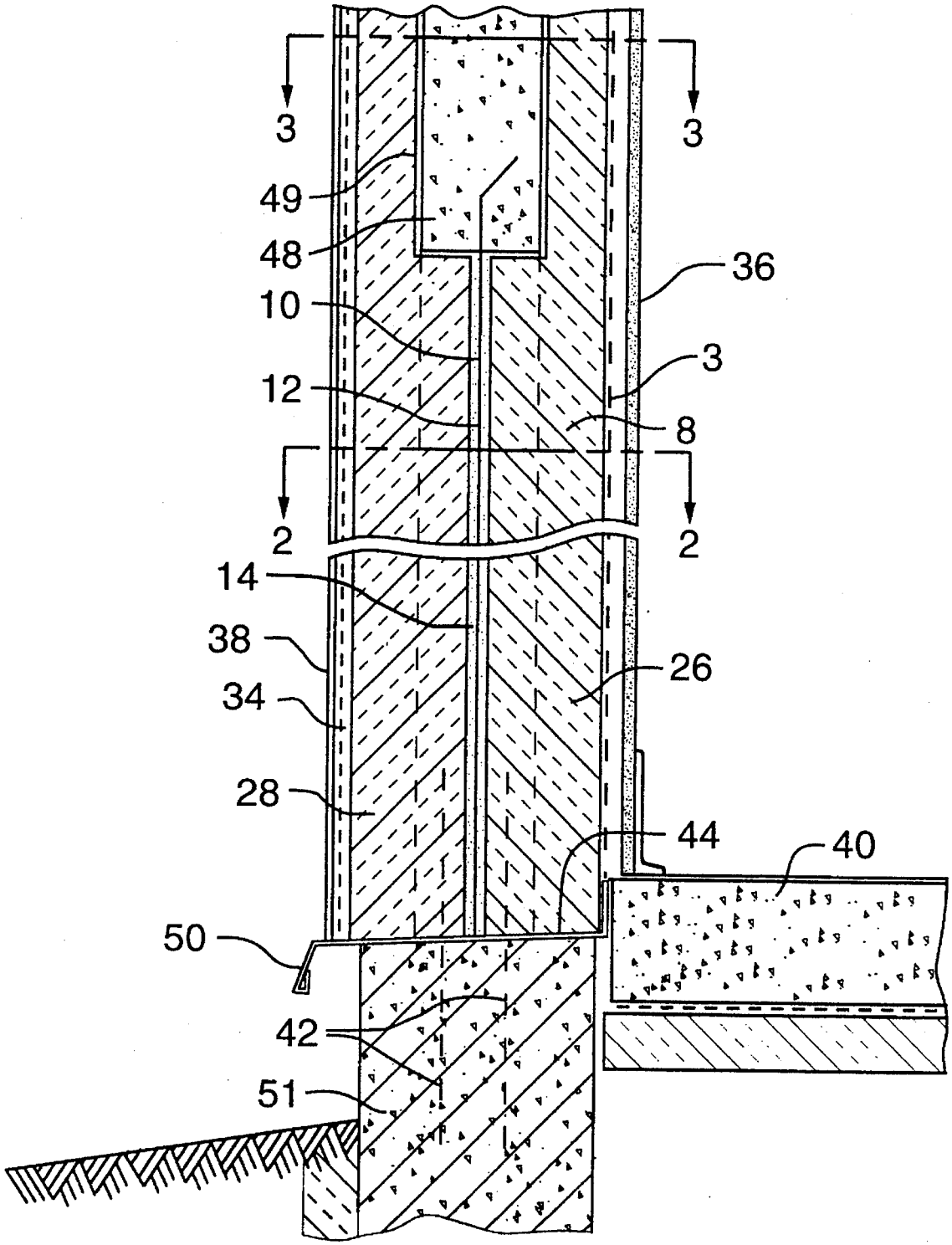
FIG. 1 is a vertical section through a panel, column and beam.
Figure 2:
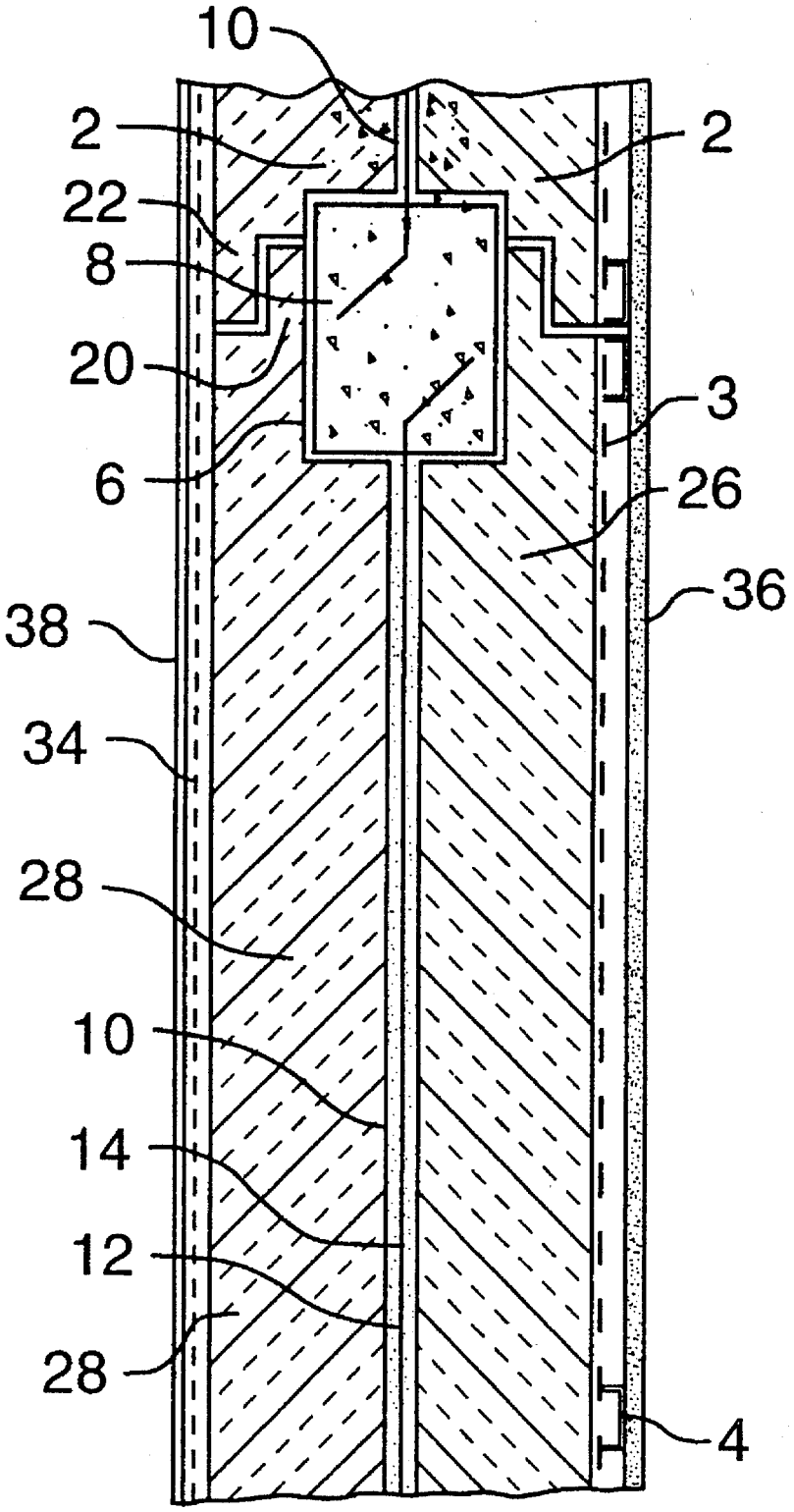
FIG. 2 is a section taken along line 2—2 of FIG. 1.
Figure 3:
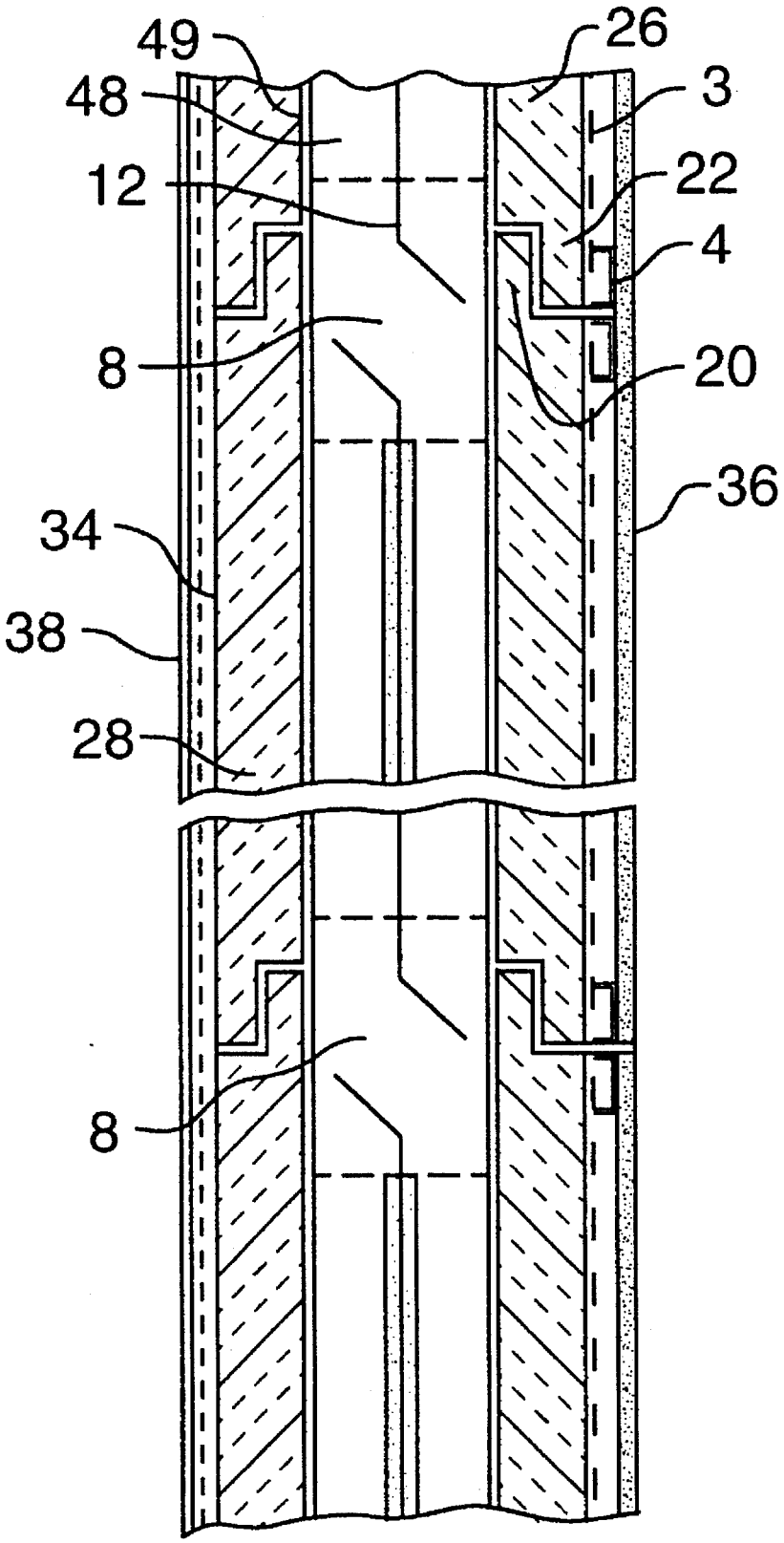
FIG. 3 is a section taken along line 3—3 of FIG. 1.

The panel has cavities at the side and top edges for receiving structural members. One such cavity is shown in FIG. 2 as cavity 6, which in this case now has the structural column member 8 located therein. The cavity 6 allowed cement material to be poured into the cavity 6 and act as a form for the cement column 8. Note that the reinforcing mesh 12 from each of the panels 2 is embedded within the cement column. This provides a very strong mechanical connection between the structural core 10 of each panel and the resulting column 8. It similarly makes a strong structural connection with the cement beam 48 of FIG. 1 and FIG. 3, which is located within and extending between two stacked panels with the reinforcing mesh of each panel extending into the cement beam. The cement beam can also include its own steel reinforcing. Note that the beam 48 is located within cavity 49 formed in the top edge of the aligned panels. With this structure and the appropriate cavities at the edges of the panels and the extension of the reinforcing mesh 12 into these materials, a complete network is formed and the structural strength of the resulting wall is a result of the combined strength of the components, which have now essentially been integrated or connected at a host of locations. Thus, the resulting wall structure has a very significant portion of the resulting strength due to the strength of the structural core 10 cooperating with the cement or steel framework.

Note that the abutting panels have a spline connection defined by a male end 20 which is received within a female end 22 of an adjacent panel. This provides good thermal continuity and a strong interaction between the panels.

Each panel includes insulation. In this case, there is an insulation layer 26 located to the interior side of the structural core 10 and an exterior insulation shown as 28. In a preferred embodiment, the insulation is of a foam material, such as a rigid foam, and the inside and outside insulation 26 and 28 form a cavity therebetween in which the structural core 10 is located. In the fabrication of the panel, the mesh can be located between the two insulation layers, the insulation layers form a cavity and the cement type material or other high strength moldable material can be injected into the cavity to fill the cavity to not only define the structural core, but to effectively connect the inside and outside insulation. The prefabricated panel at the interior edge includes an optional fibre mesh 32 to provide additional reinforcing for the insulation, which is then covered by an inside finish material 36 which, in many cases, will be gypsum board.

The panel 2 also includes a basecoat and a fibre mesh 34 located to the exterior of the outside insulation as well as a finish-material 38 located therebeyond. Thus, it can be realized that the exterior of the panel includes a finish material suitable for the final product. Also, the inside surface of the panel has gypsum board which would be suitable for subsequent taping and finishing.

A prefabricated panel, according to this design, has excellent strength, and thus, can easily be handled on the job and is not prone to damage. It is also relatively light and can be sized for handling by two labourers.

In the building system, typically a concrete slab 40 (FIG. 1) or other type slab would be in place, at which time the panels can be assembled on the slab. The slab can include a depression 44 for receiving the lower edge of the panels to effectively locate the panels on the slab. The lower panels at the bottom thereof can also be attached to the base footing. The panels are placed in abutment to form vertical cavities 6 between abutting panels and the reinforcing mesh is located within these cavities. The cavity can then be filled with a cement type material or other moldable material to form a strong upright. In addition, at the upper edge of the panels, there is a cavity 49 and a concrete beam 48 is formed in the length of the panels. As can be appreciated, this beam would be continuous between panels and the beam can be integrally connected to the panels located therebelow, as a reinforcing mesh of the structural core also extends into these beams. The beam is also integral with the columns. The concrete slab also has reinforcing rods 42 located to form anchors for the columns and thereby secure the panels to the slab.

In some cases, it may be preferable to have the structural members be metal columns and metal beams. In this case, the reinforcing mesh 12 is of suitable metal and is directly attached by welding to these structural members which are received within the cavities. These members can be of a longer length to provide integration between adjacent panels, and thus, strengthen the joint between abutting panels. Similarly, the anchor rods 42 can also be secured by welding to the vertical columns, thereby securing the columns to the slab. The steel columns can be secured to the concrete slab by use of specially designed connections installed prior to panel and column delivery.

The prefabricated panels allow both single and multistory buildings to be constructed and greatly simplify the time required and the degree of skill of the labour force necessary to assemble the building. The efficiency of prefabrication of the building panels at a different location and transportation of the panels to the final building site help to keep the cost low. The prefabricated building panel has excellent structural strength and significantly contributes to the overall strength of the resulting building. This is in contrast to many designs where prefabricated panels merely provide infill and do not substantially contribute to the overall strength of the system, other than to meet mere requirements of their dead load, windows, wind load, etc.

In conventional building construction, the process is a step by step erection of structural, infill, insulation and finishes when building an outside wall. This is in contrast to the prefabricated system of the present invention, which has all, or provision for all, components to be in place. The structural stability becomes an integral part of the process of prefabrication and is greatly influenced by the structural strength of the core. The system can also include interior cavities into which wiring, etc. can be placed. Thus, the panels can include their own built-in conduits, which are either closed in the final finishing of the system or are merely cavities running the length of the system and access is gained in the field.

All openings, such as windows, doors, etc., can be framed in the panel at the time of prefabrication.

The prefabricated panel forms an exterior insulated bearing wall. The exact materials used for the insulation and the interior and exterior finishes can obviously change, depending upon the climatic conditions and the availability of suitable materials.

As can be seen in the drawings, the building panels provide excellent insulation and effectively no thermal bridging occurs as the insulation forms two effective thermal barriers.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A building wall comprising a plurality of prefabricated interconnected panels where each panel provides infill and substantially contributes to structural stability of the building wall, each prefabricated panel comprising an exterior portion, a structural core portion and an interior portion, said structural core includes a reinforcing grid structure there throughout, with said reinforcing grid structure being embedded in a moldable material generally within the panel, said reinforcing grid structure extending into and cooperating with separate columns and beams located at the sides of said panels thereby integrating said panels with said columns and beams.

2. A building wall as claimed in claim 1 wherein said moldable material of each panel is a type of cement.

3. A building wall as claimed in claim 2 wherein said reinforcing grid structure of each panel is of metal.

4. A building wall as claimed in claim 3 wherein each panel includes insulation either side of said core.

5. A building wall as claimed in claim 4 wherein said insulation material of each panel forms a cavity therebetween and said core is generally retained in said cavity.

6. A building wall as claimed in claim 5 wherein each panel includes an exterior finish material on one side thereof and an interior finish material on an opposite side thereof.

7. A building wall as claimed in claim 6 wherein each panel is generally rectangular and has on at least edge portions thereof between said exterior and interior finish materials an elongate cavity which partially accommodate one of said columns or beams.

8. A building wall comprising a plurality of prefabricated panels connected in an end to end manner, each prefabricated panel comprising an exterior portion, a structural core and an interior portion, each structural core having a reinforcing grid joining and cooperating with vertical and horizontal structural members located between adjacent panels; and wherein said vertical and horizontal structural members are made of a cement type material and said structural reinforcing grids of said panels are partially embedded in said structural members.

9. A building wall as claimed in claim 8 wherein each panel includes an exterior finish material on one side of said panel and an interior finish material on an opposite side of said panel.

10. A building wall as claimed in claim 8 wherein each reinforcing grid is embedded in a cement type material within the panel thereby forming a discrete high strength layer of the respective panel.

11. A building wall as claimed in claim 8 wherein each reinforcing grid is embedded in a moldable material generally within the panel.

12. A building wall comprising a plurality of prefabricated panels interconnected along vertical sides of the panels by structural columns and interconnected along top sides by a structural beam where said structural beam is supported by said structural columns; each panel including a structural core having a reinforcing grid structure embedded in a moldable material, said reinforcing grid structure extending beyond the sides of the panel into adjacent structural columns and structural beam to integrate each panel to said structural columns and beam.

13. A building wall as claimed in claim 12 wherein each panel includes an exterior portion to one side of said structural core and an interior portion on a side of said structural core opposite said exterior portion.

14. A building wall a claimed in claim 13 wherein said building wall includes a base footing at a bottom of said wall and said structural reinforcing grid of each panel in contact with said base footing is attached to said base footing along a lower edge of each panel.

15. A building wall as claimed in claim 13 wherein said exterior portion of each panel includes an exterior finish surface.

16. A building panel as claimed in claim 15 wherein said interior portion of each panel includes an interior finish material on an exposed surface thereof.

17. A building wall as claimed in claim 12 wherein said structural columns and said structural beams are of reinforced cement type material.

18. A building wall as claimed in claim 15 wherein said structural columns and beam are partially located within recesses at the edges of said panels.

* * * * *